United States Patent [19]

Henriksson

[11] Patent Number: 4,896,425

[45] Date of Patent: Jan. 30, 1990

[54] ARRANGEMENT OF A THROTTLE CONTROL ON A MOTOR SAW

[75] Inventor: Sören N. Henriksson, Kållered, Sweden

[73] Assignee: Aktiebolaget Electroleux, Stockholm, Sweden

[21] Appl. No.: 230,191

[22] Filed: Sep. 19, 1988

[30] Foreign Application Priority Data

Aug. 11, 1987 [SE] Sweden ..... 8703124

[51] Int. Cl.[4] ..... B27B 17/00

[52] U.S. Cl. ..... 30/381; 74/96; 74/491; 123/400

[58] Field of Search ..... 123/400, 403; 74/491, 74/96; 30/381–387

[56] References Cited

U.S. PATENT DOCUMENTS 4,382,333 9/1981 Nagashima et al. ..... 30/381

4,785,539 11/1988 Nagashima ..... 30/381

FOREIGN PATENT DOCUMENTS 542916 1/1932 Fed. Rep. of Germany ..... 123/403

*Primary Examiner*—Douglas D. Watts

*Attorney, Agent, or Firm*—Pearne, Gordon, McCoy & Granger

[57] ABSTRACT

The motor saw has a rear handle connected to the body by vibration-damping elements with rubber or steel springs, and the throttle of the carburetor and the throttle control are connected by a rigid wire link. The throttle control bearing includes a shaft mounted in oblong holes to give a longitudinal play so that when the handle is moved with respect to the body, the throttle control can move the corresponding distance in the bearing without influencing the setting of the throttle in the carburetor in its idle position. When the handle is moved in this position, and a throttle opening is desired by moving the throttle control, a sliding part at the rear end of the throttle will contact a curved partition in the handle and push the throttle control to an advanced position, after which an opening of the throttle takes place by further movement of the throttle control.

4 Claims, 2 Drawing Sheets

ARRANGEMENT OF A THROTTLE CONTROL ON A MOTOR SAW

BACKGROUND OF THE INVENTION

The present invention relates to an arrangement for eliminating involuntary openings of the throttle valve on a motor saw.

Arrangements for rotating a throttle valve usually comprise a lever and a Bowden-cable or a system of links transmitting the setting movement from a finger grip to the pivot shaft of the throttle. Because the engine of a motor saw is not rigidly connected to the handles but is suspended in vibration-damping members, it is able to move relative to the handles when the saw operates under load or is carried. The vibration damping members have a disadvantage when a direct connection between the throttle of the carburetor and the finger grip control (the throttle control) is effected by means of a wire link, because the members cause the wire link to move, causing involuntary throttle openings when the handle makes a movement relative to the engine. It is therefore important that means are created for keeping the throttle in a predetermined position under circumstances when the engine and the handle move relative to each other.

SUMMARY OF THE INVENTION

The problem of involuntary throttle openings is, according to the invention, solved by creating a play in the bearing of the finger grip and/or in the bearing between the finger grip and the connecting link of the throttle valve, and using a curved partition in the handle of the saw. When the handle is pushed in the longitudinal direction of the saw, the throttle control can move in its bearing through a corresponding distance without changing the position of the carburetor throttle when the motor is idling or during operation. An arrangement with improving properties of that kind shall, according to the invention, be created as set forth in the characteristics of claim 1.

BRIEF DESCRIPTION OF THE DRAWING

An arrangement according to the invention is described in the following with reference to the enclosed drawing, showing in:

The arrangement consists of a lever system for transmitting a turning movement from a throttle control 10 to a throttle pivot shaft 11. The throttle control 10 is journalled for longitudinal play in bearings by means of a shaft 12 in oblong holes 13 on a handle 14 of a motor saw body, the rear end of which is shown in the Figures. The handle is secured by means of rubber members 15, 16 to a fork 17 protruding from the motor body. In FIG. 1 the handle is in its rest position but in FIG. 2 and FIG. 3 it is in its advanced position which can occur during operation or carrying. This advanced position is achieved when the rubber elements yield to a pressure exerted by the operator. FIG. 2 and FIG. 3 illustrate that the center of the rubber member 15 has been pushed forward a distance A from its position in FIG. 1.

Figure 1:
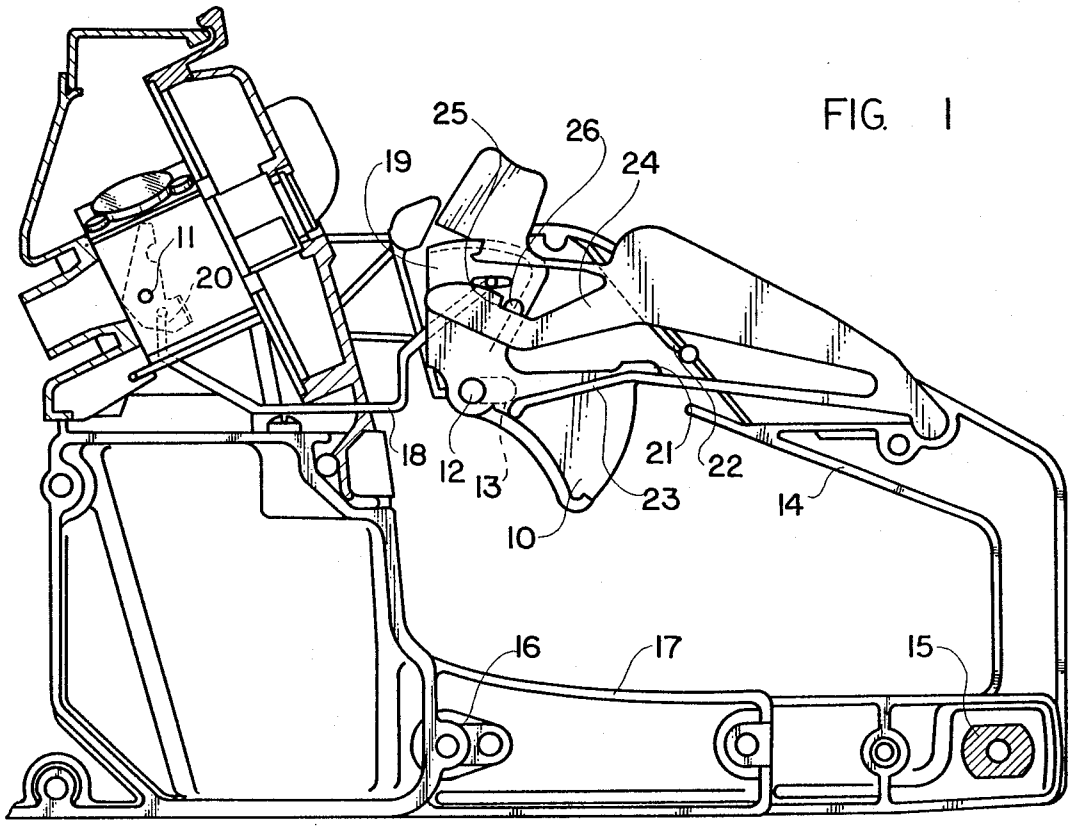
FIG. 1 is a longitudinal cross-sectional view of the rear handle portion of a motor saw according to the preferred embodiment of the invention.
Figure 3:
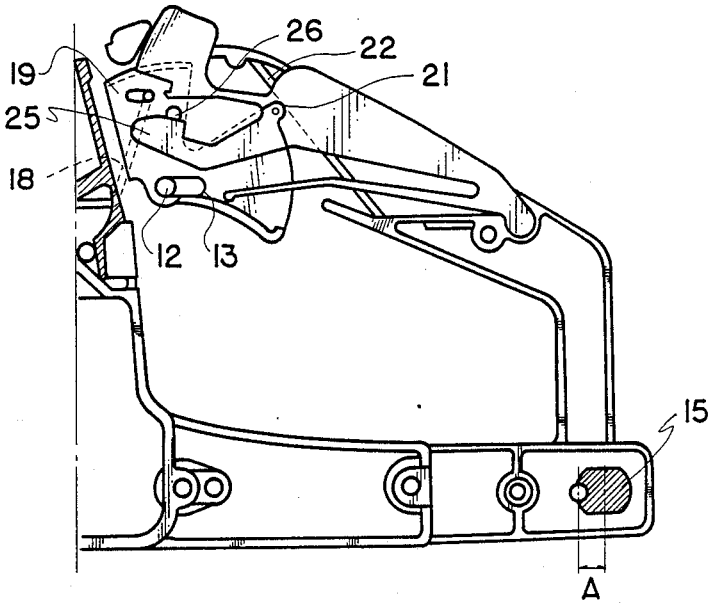
FIG. 3 is a view similar to FIGS. 1 and 2 but with advanced handle during throttle opening.

The throttle control 10 in FIG. 1 is shown in its idle position but it can be depressed, and consequently rotated, around the shaft 12 to full speed as illustrated in FIG. 3. Its rotating movement is displaced by a link 18 connected to a protruding part 19 of the throttle control 10 an arm 20 on the throttle pivot shaft 11. During the rotating movement a guiding lip 21 at the rear edge of the throttle control 10 contacts a curved partition 22 firmly arranged in the handle. A sliding motion of the lip 21 on the partition 22 causes the throttle control 10 to be pushed or moved forward in the handle and thus initiate, via link 18, a full speed position on the shaft 11. The throttle control 10 has a return spring 23 which brings it back to its idle position when the throttle control 10 is released and the guiding lip 21 slides back to the initial position on the curved partition 22.

Figure 2:
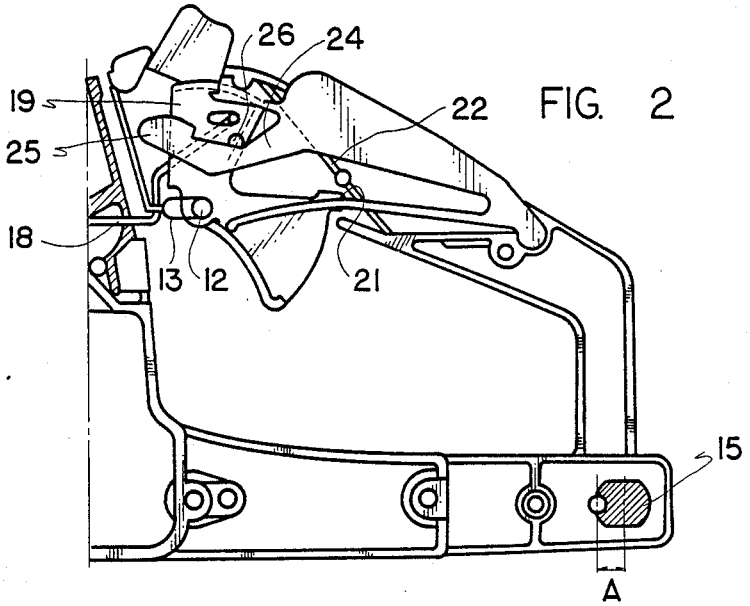
FIG. 2 is a view similar to FIG. 1 but with the handle in the advanced position without throttle opening.

In the handle there is also a latch 24 which in the position shown in FIG. 1 blocks the throttle control in its idle position because a hook 25 is immediately adjacent a projection 26 of the protruding part 19. As soon as the latch 24 is released by pushing it into the handle, so that the hook is lowered under the projection 26 according to FIG. 3, the throttle control 10 can be rotated to full speed position. In FIG. 2 a position is illustrated where the hook 25 is just in front of the projection 26 when the handle is advanced, as the throttle control 10 and projection 26 are held back by the link 18. In this position (FIG. 2) the locking function created by the hook 25 and the projection 26 in FIG. 1 has been taken over by the guiding lip 21 which is under the curved partition 22 and prevents the turning of the throttle control 10.

As indicated in the introduction the idle position shall be maintained if the handle is advanced. It is apparent from FIG. 2 that the throttle control 10 and consequently the throttle of the carburetor maintain their positions when a pushing of the handle is effected. Furthermore, arrangement has no negative influence on the throttle control 10 during operation because the curved partition 22 and the guiding lip 21 provide the desired function of the control.

I claim:

1. Arrangement of a throttle control on a motor saw having an engine and at least a rear handle fitted to the saw body by means of vibration-damping elements (15, 16), comprising a throttle control (10), a link and lever system (18, 19) and pivotable throttle on a pivot shaft in the engine, wherein the bearing of the throttle control in said rear handle is made with play in the longitudinal direction of the saw which allows movement of the throttle control in said direction through a distance equal to the maximum amplitude of the vibrations absorbed by said vibration-damping elements.

2. Arrangement according to claim 1, wherein the position of the throttle control in the bearing is guided by a guiding lip (21) and a curve partition (22) of which one is situated on the throttle control and the other connected to the rear handle.

3. Arrangement according to claim 1, wherein the bearing consists of a shaft pin (12) on the throttle control and oblong holes extended in the longitudinal direction of the saw on the sides of the rear handle.

4. Arrangement according to claim 3, wherein the link and lever system has a return spring (23) urging the shaft pin toward the front end of the oblong holes.

* * * * *